US005590834A

United States Patent [19]

Foster

[11] Patent Number: 5,590,834

[45] Date of Patent: Jan. 7, 1997

[54] ONE-PIECE TRIGGER SPRAYER HOUSING

[75] Inventor: Donald D. Foster, St. Charles, Mo.

[73] Assignee: Contico International, Inc., St. Louis, Mo.

[21] Appl. No.: 279,592

[22] Filed: Jul. 22, 1994

[51] Int. Cl.[6] ..... B05B 11/02

[52] U.S. Cl. ..... 239/333; 239/493; 239/526

[58] Field of Search ..... 239/525, 526, 239/530, 493, 329–333, 375; 222/383, 386, 384

[56] References Cited

U.S. PATENT DOCUMENTS

| | | | |
|---|---|---|---|
| Re. 33,235 | 6/1990 | Corsette . | |
| D. 337,945 | 8/1993 | Warner . | |
| 3,061,202 | 10/1962 | Tyler . | |
| 3,076,608 | 2/1963 | Valles | 239/520 |
| 3,474,938 | 10/1969 | Clevenger | 239/333 X |
| 3,650,473 | 3/1972 | Malone | 239/333 |
| 3,840,157 | 10/1974 | Hellenkamp | 222/309 |
| 4,072,252 | 2/1978 | Steyns et al. | 222/341 |
| 4,153,203 | 5/1979 | Tada | 239/333 |
| 4,230,277 | 10/1980 | Tada | 239/333 |
| 4,310,107 | 1/1982 | Wesner | 239/333 |
| 4,346,821 | 8/1982 | Wesner et al. | 222/214 |
| 4,448,355 | 5/1984 | Roman | 239/526 |
| 4,606,480 | 8/1986 | Gazulla | 222/341 |
| 4,640,444 | 2/1987 | Bundschuh . | |
| 4,915,304 | 4/1990 | Campani | 239/526 X |
| 4,944,431 | 7/1990 | Blake | 222/276 |
| 4,955,511 | 9/1990 | Blake | 222/321 |
| 4,958,754 | 9/1990 | Dennis | 222/383 |
| 4,982,900 | 1/1991 | Blake | 239/333 |
| 5,172,836 | 12/1992 | Warner . | |
| 5,222,637 | 6/1993 | Giuffredi | 222/336 |
| 5,228,602 | 7/1993 | Maas et al. | 222/383 |
| 5,244,126 | 9/1993 | Geier . | |
| 5,385,302 | 1/1995 | Foster et al. | 239/333 |

FOREIGN PATENT DOCUMENTS

| | | | |
|---|---|---|---|
| 8701618 | 3/1987 | WIPO | 239/333 |

*Primary Examiner*—Kevin Weldon
*Attorney, Agent, or Firm*—Howell & Haferkamp, L.C.

[57] ABSTRACT

A trigger sprayer has a one-piece housing with a shroud having sides which extend rearward to an integral ergonomic saddle the sides connected by ribs and a surface configured to rest upon the user's hand during trigger sprayer actuation. The housing also incorporates an integral barrel, pump cylinder and vent passage cylinder.

20 Claims, 2 Drawing Sheets

ONE-PIECE TRIGGER SPRAYER HOUSING

BACKGROUND OF THE INVENTION

This invention is related to the field of trigger dispensers, also known as trigger sprayers. The invention is particularly directed to a trigger sprayer having a housing with numerous features integrally molded therein including a shroud having sides which extend rearward to an integral ergonomic saddle having a surface configured to rest upon the user's hand during trigger sprayer actuation.

There are numerous patents that have issued on trigger dispensers of the general type to which this invention relates. The patents discussed below exemplify such prior art trigger dispenser patents. Generally, a trigger dispenser of the type involved here is a relatively low cost pump device which may be grasped in the hand and has a pump chamber which is operable by pulling a trigger to pump liquid from a container and through a nozzle at the front of the dispenser.

Such trigger dispensers may have a variety of features that have become common and well known in the industry. For example, the dispenser may have a vent system to prevent a vacuum from developing in the container as liquid is removed therefrom. If no vent system is included, the vacuum eventually prevents the trigger dispenser from pumping the liquid from the container. Many of these vent systems are connected to the trigger such that as the trigger is actuated, the vent is repeatedly opened and closed at appropriate points in the pumping cycle to relieve the vacuum.

U.S. Pat. Nos. 3,840,157 and 5,222,637 disclose trigger dispensers having ergonomic saddles with surfaces configured to rest upon the user's hand during trigger sprayer actuation. However, the particular configurations do not employ shrouds, thus making the functional structures of the trigger dispensers visible to the user. A smoother, more streamlined configuration is more aesthetically desirable. As a result, shrouds are typically used to give the housing a more streamlined appearance.

U.S. Pat. No. 4,958,754 discloses a trigger dispenser which has a housing with an integrally molded shroud. This shroud makes the housing more streamlined and appealing. The shroud is integrally molded with the housing to reduce assembly costs by eliminating a separate component. The shroud includes a saddle which rests on the user's hand during use to aid the user in grasping the dispenser. However, molding constraints require that the bottom of saddles of this type be open, and therefore a surface is not provided on the saddle to rest upon the user's hand during trigger sprayer actuation. Rather, the edges of the saddle surrounding the opening rest upon the user's hand. When a load is distributed over a relatively small area, the stress associated with that load is increased. In this instance since the stress is in the user's hand, the user's comfort level is reduced by a reduction in loaded area. Thus, while sprayers of this type provide an aesthetic housing with numerous advantages, the level of comfort is less than optimal.

U.S. Pat. No. 5,228,602 discloses yet another trigger dispenser which is partially shrouded. The forward section of this dispenser is shrouded so as to provide a streamlined appearance. Depending from the rearward side of the shroud is a band which forms an ergonomic saddle. Although this saddle has a surface to rest upon the user's hand during trigger sprayer actuation, the overall appearance of the housing is not streamlined because the sides of the shroud do not extend rearward over the saddle. Thus, as with the aforementioned patents, this patent does not solve the problem of providing a one-piece shrouded housing with a totally streamlined appearance and an ergonomic saddle with a surface configured to rest upon the user's hand.

Part of the difficulty in producing a housing having an integral shroud with a totally streamlined appearance as well as a surface to rest upon the user's hand is the constraints of plastic molding. Plastic parts must be molded with relatively thin cross-sections to prevent unsightly shrinkage voids. Thus, plastic parts are frequently made hollow to keep the cross-sectional thicknesses thin. However, a hollow cannot be created within a trigger dispenser housing without leaving an opening somewhere in the housing for the mold to withdraw from the hollow. If the opening is put in the housing at the bottom of the saddle, then the saddle surface is broken by the opening. As a result, the edges of the opening rest upon the user's hand and cause a reduction in comfort. Alternatively, the opening may be placed at the top or at the side but this reduces the aesthetic appeal of the trigger dispenser which is the purpose of the shroud in the first place. Thus, in the prior art where a surface for the user's hand has been provided in the saddle, aesthetics have been sacrificed, and where aesthetics have not been sacrificed, a surface for the hand has not been provided.

The present invention overcomes these disadvantages of the prior art trigger dispensers and provides a unique trigger dispenser having a housing with an integral shroud which has a totally streamlined appearance and a surface to rest upon the user's hand during the trigger dispenser actuation.

SUMMARY OF THE INVENTION

The trigger dispenser of the present invention has a one-piece housing which includes an integral shroud. The shroud has sides which extend rearward to an integral ergonomic saddle having a surface configured to rest upon the user's hand during trigger sprayer actuation. The upper surface of this saddle is open, but ribs extend laterally between the sides of the shroud to both stiffen the saddle and enhance the aesthetics of the housing. The result is the trigger dispenser has a streamlined shroud with a pleasing appearance.

In the preferred embodiment, several other features are also integrally molded into the one-piece housing. These features include an output barrel and a primary valve seat. A pump cylinder which forms a part of a pump chamber is also integrally molded to the housing, as are a valve seat and passage which form the vent system. Additionally, a receptacle is formed in the housing to receive an inlet passage assembly. The resulting structure is a low cost unit which provides enhanced comfort for the user without sacrificing aesthetic appeal.

DETAILED DESCRIPTION OF THE PREFERRED EMBODIMENT

Figure 1:
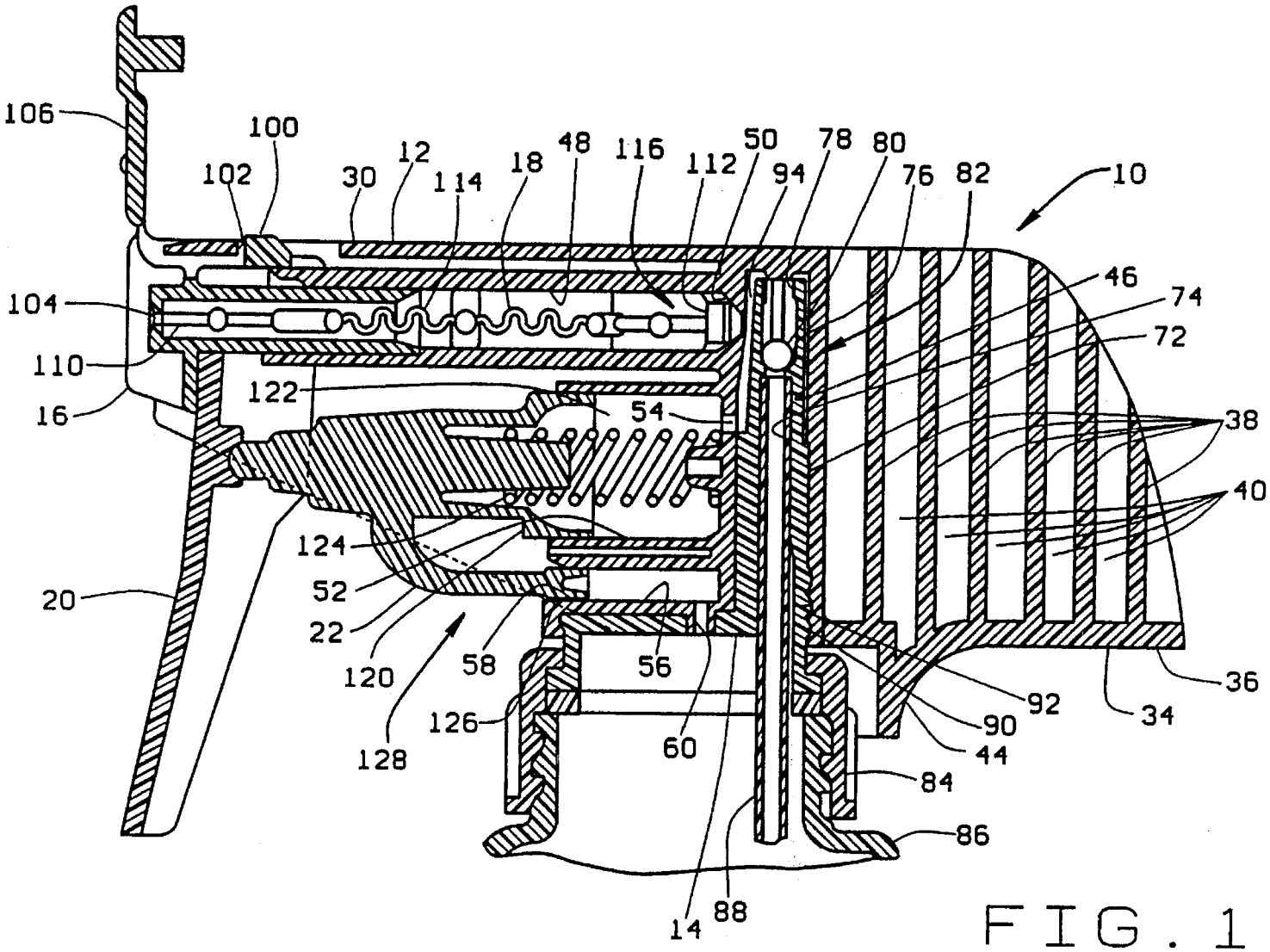
FIG. 1 is a view in section of the preferred embodiment of the one-piece housing of the present invention.

A trigger dispenser 10 is assembled from the one-piece housing 12 of the present invention. Other major components of the trigger dispenser include an inlet passage assembly 14, a nozzle assembly 16, a spinner assembly 18, a trigger 20, and a plunger 22.

Figure 2:
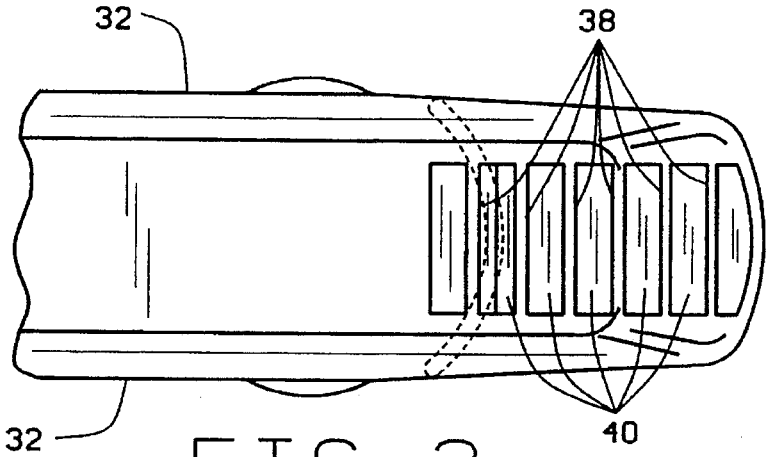
FIG. 2 is a top plan view of the saddle portion of the one-piece housing.
Figure 3:
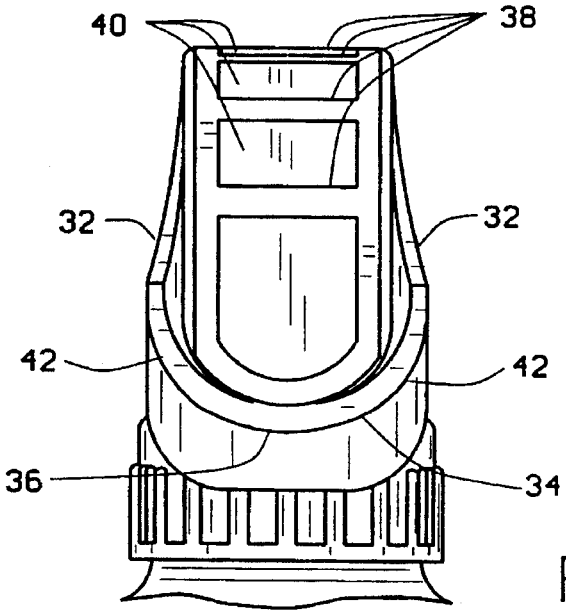
FIG. 3 is a rear elevation view of the saddle portion of the one-piece housing.
Figure 4:
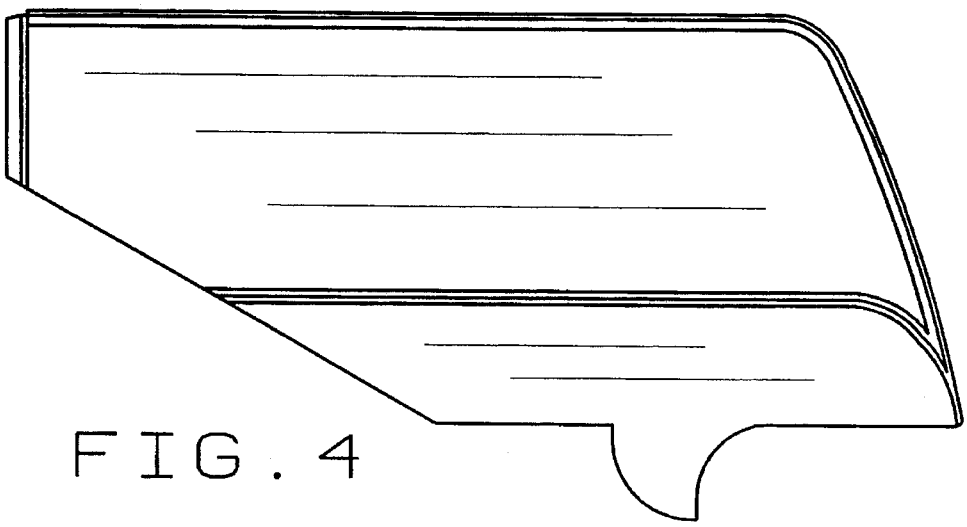
FIG. 4 is a side elevation view of the one-piece housing.

The housing 12 has a shroud 30 which gives a streamlined appearance to the trigger dispenser. As best seen in FIG. 3, the sides 32 of the shroud extend rearward to an integral ergonomic saddle 34 which rests upon the web of the user's hand between the index finger and thumb during trigger sprayer actuation. At the bottom of the saddle 34 is a surface 36 which actually contacts the user's hand. Immediately above this surface 36 are several ribs 38 which extend laterally between the sides 32 of the shroud. As best seen in FIG. 2, these ribs 38 in combination with the openings 40 formed therebetween give an appealing appearance to the housing 12 and also provide openings through which the mold may be extracted from the hollow interior. The intersections of the surface 36 and the sides 32 have generous radii 42 to further enhance the user's comfort. In addition, as seen in FIG. 1 the forward edge of the surface 36 has a fillet 44 which even further improves the user's comfort.

Immediately in front of the saddle 34 and ribs 38 is a cylindrical recess which forms a receptacle 46 for the inlet passage assembly 14. Near the top of this receptacle 46 is an opening which extends into a horizontal outlet barrel 48 through which liquid is dispensed. A primary valve seat 50 is integrally molded into the rearward end of the outlet barrel 48 immediately in front of the inlet passage assembly receptacle 46. A pump cylinder 52 is located below the outlet barrel 48 and spaced therefrom to reduce the cylinder wall thicknesses and inhibit shrinkage voiding. At the rearward end of the pump cylinder 52 is a pump chamber opening 54 which permits liquid to enter and exit the pump cylinder 52. Below the pump cylinder 52 is a vent passage cylinder 56 which is spaced from the pump cylinder 52 to reduce the required cylinder wall thicknesses to inhibit shrinkage voiding. At the forward end of the vent passage cylinder 56 is a vent valve seat 58. On the lower wall of the vent passage cylinder 56 near the rearward end is a vent opening 60. It should be noted that although the term "cylinder" is used to describe the pump and vent features, this is not intended to be a geometric limitation. Cylinder is used to mean any tubular configuration. Nonetheless, the cylinders do have circular cross-sections in the preferred embodiment.

The inlet passage assembly 14 has a vertical tubular extension 72 which is received directly into the receptacle 46. A dip tube receptacle 74 is formed in the lower portion of the tubular extension 72. Immediately above this receptacle 74 is a secondary valve seat 76. Keepers 78 protrude into the hollow of the tubular extension 72 adjacent the top thereof. A ball valve body 80 is retained between the keepers 78 and the secondary valve seat 76 to form the secondary valve 82. At the lower end of the inlet passage assembly 14 is a closure means 84. Although numerous fastener types could be used, the closure 84 depicted in the drawing figures is a typical screw-type fastener. This closure 84 is used to fasten the trigger dispenser to a container 86 in which the liquid is held for dispensing. A dip tube 88 extends from the dip tube receptacle 74 of the inlet passage assembly 14 to the bottom of the container 86. The inlet passage assembly 14 is retained within the inlet passage means receptacle 46 by mating ridges 90 and grooves 92. An annular passage 94 is formed between the inlet passage assembly 14 and receptacle 46 to permit liquid to flow from the secondary valve 82 to the pump chamber opening 54.

The nozzle assembly 16 is received in the forward end of the outlet barrel 48 and is retained in place by a detent 100 which protrudes through an opening 102 formed in the shroud 30. At the forward end of the nozzle assembly 16 is an orifice 104 through which liquid is dispensed. A hinged sealing means 106 is provided on the nozzle assembly 16 to seal the orifice 104 and prevent leakage therefrom during shipment and storage.

The spinner assembly 18 is retained within the outlet barrel 48 behind the nozzle orifice 104. The spinner assembly 18 is comprised of a spinner head 110 which imparts a swirl to the liquid as it exits the orifice 104 to improve the spray pattern. At the rearward end of the spinner assembly 18 is a valve body 112 which is biased against the primary valve seat 50 by a spring section 114 to form the primary valve 116.

A piston 120 formed in the plunger 22 reciprocates within the pump cylinder 52 to form a pump chamber 122. A coil spring 124 biases the piston 120 in the extended position as shown in FIG. 1 so as to increase the internal volume of the pump chamber 122. Extending from the plunger 22 is a poppet 126 which reciprocates within the vent passage cylinder 56 and seats against the vent valve seat 58 to form a vent valve 128. The trigger 20 rests against the plunger 22 and is hinged within the housing 12 to provide leverage for the user to actuate the plunger.

To operate the trigger dispenser, the user grasps the trigger dispenser in his hand such that the saddle is resting on the web of the hand between the thumb and index finger and the fingers are wrapped around the trigger. The user pulls the trigger which causes the plunger to move rearward within the pump cylinder such that the interior volume of the pump chamber is reduced, thereby forcing liquid in the pump chamber through the pump chamber opening and into the annular passage. The secondary valve is forced closed and the primary valve is forced open by the fluid pressure. Thus, fluid is forced through the outlet barrel, past the spinner head, and out the nozzle orifice. When the user releases the trigger, the coil spring forces the plunger forward thereby expanding the interior volume of the pump chamber and causing a reduction in pressure in the pump chamber which closes the primary valve and opens the secondary valve. Thus, liquid is drawn from the container, through the dip tube, past the secondary valve, through the annular passage, and into the pump chamber as the pump chamber expands thereby filling the pump chamber with liquid which may be dispensed upon the following contraction of the pump chamber as described above.

As liquid is removed from the container, a vacuum develops in the container. If this vacuum were not corrected, eventually the trigger dispenser effectiveness would be reduced or would cease entirely. Thus, the vent system is included in the trigger sprayer. When the trigger is pulled, the poppet on the plunger is unseated from the vent valve seat thereby opening the vent valve and permitting ambient air to enter the vent valve, traverse the vent passage cylinder, and enter the container through the vent opening. When the plunger is in the forward position, the poppet seats against the vent valve seat to close off this passageway.

Most of the components of the trigger dispenser of the preferred embodiment are plastic. However, the coil spring and ball valve body may be metallic to improve their performance. Because the housing integrally incorporates so many features, fewer component parts are required in the preferred embodiment of the present invention than in many prior art trigger dispensers. Reduction in the number of component parts inherently reduces the handling and assembly costs of manufacturing the dispensers. Because an integral shroud is provided with a sleek appearance, aesthetics are improved over many prior art one-piece housing trigger dispensers. Additionally, because the saddle incorporates a surface to rest upon the user's hand, the trigger dispenser of the present invention is more comfortable to use than other shrouded one-piece housing designs with aesthetic appeal comparable to the present invention. Therefore, the present invention overcomes the problems inherent in prior art trigger dispensers.

While the present invention has been described by reference to a specific embodiment, it should be understood that modifications and variations of the invention may be constructed without departing from the scope of the invention defined in the following claims.

What is claimed is:

1. A trigger sprayer for dispensing a liquid substance from a container in response to actuation of the trigger sprayer by a user's hand, the trigger sprayer comprising:

a one-piece housing having a shroud with a pair of sides extending to an integrally-formed ergonomic saddle having an upper edge and a lower surface, each of the pair of sides extending between the upper edge and the lower surface and partially enclosing a hollow interior having an opening above the lower surface and between the pair of sides, the opening being sized for extraction of a mold from the hollow interior, the lower surface extending from one of the pair of sides to the other and being configured to rest upon the user's hand during trigger sprayer actuation, the housing also including an elongate outlet bore extending longitudinally through the housing from a rearward end to a forward end and a primary valve seat formed in the rearward end of the outlet bore;

a nozzle assembly mounted at the forward end of the outlet bore, the nozzle assembly having an orifice in fluid communication with the outlet bore through which the liquid substance is dispensed during trigger sprayer actuation;

a spinner head mounted behind the nozzle orifice for imparting a swirl to the liquid substance flowing through the nozzle orifice;

a pump chamber positioned within the housing shroud in fluid communication with both the primary valve seat and the container for drawing the liquid substance from the container in response to a decrease in pressure in the pump chamber and expelling the substance through the nozzle orifice in response to an increase in pressure in the pump chamber, the decrease and increase in pressure in the pump chamber resulting from trigger sprayer actuation; and a primary valve body biased against the primary valve seat and configured to mate with the primary valve seat to inhibit the flow of the liquid substance through the primary valve seat in response to the decrease in fluid pressure in the pump chamber and to permit the flow of the substance through the primary valve seat in response to the increase in fluid pressure in the pump chamber.

2. The trigger sprayer of claim 1 wherein the pair of sides are spaced by a plurality of laterally-aligned ribs extending between the pair of sides.

3. The trigger sprayer of claim 2 wherein the plurality of ribs extend from the lower surface to the upper edge of the housing saddle.

4. The trigger sprayer of claim 2 wherein the plurality of ribs are spaced by a plurality of openings, each of the openings being bounded by two of the plurality of ribs and the pair of sides.

5. The trigger sprayer of claim 4 wherein each of the plurality of openings is rectangular.

6. The trigger sprayer of claim 1 wherein the saddle includes a generous radius between each of the pair of shroud sides and the lower saddle surface.

7. The trigger sprayer of claim 1 wherein the lower saddle surface extends from a rearward edge to a forward edge, the forward edge having a fillet configured to conform to the user's hand.

8. A one-piece trigger sprayer housing for completing a trigger sprayer for dispensing a liquid substance from a container in response to actuation of the trigger sprayer by a user's hand, the trigger sprayer including a nozzle assembly with an orifice through which the liquid substance is dispensed, a spinner mounted behind the nozzle orifice for imparting a swirl to the liquid substance flowing through the nozzle orifice, a pump chamber for drawing the liquid substance from the container and expelling the liquid substance through the nozzle orifice, and a primary valve body, the trigger sprayer housing comprising:

an elongate output barrel having a longitudinal length extending from a rearward end to a forward end configured to accept the trigger sprayer nozzle assembly;

a primary valve seat formed at the rearward end of the output barrel, the seat being configured to accept the primary valve body to inhibit flow of the liquid substance through the primary valve seat in response to a decrease in pressure within the pump chamber and to permit flow of the liquid substance through the primary valve seat in response to an increase in pressure within the pump chamber; and an integral shroud enclosing the barrel, primary valve seat, and pump chamber, the shroud having a pair of sides extending rearward to an integral ergonomic saddle having an upper edge and a lower surface configured to rest upon the user's hand during trigger sprayer actuation, each of the pair of sides extending between the upper edge and the lower surface;

the pair of sides and the ergonomic saddle partially enclosing a hollow interior having an opening above the lower surface end between the pair of sides, the opening being sized for extraction of a mold from the hollow interior.

9. The trigger sprayer housing of claim 8 wherein the pair of sides are spaced by a plurality of laterally-aligned ribs extending between the pair of sides.

10. The trigger sprayer housing of claim 9 wherein the plurality of ribs are spaced by a plurality of openings, each of the openings being bounded by two ribs and the pair of sides.

11. The trigger sprayer housing of claim 9 wherein each of the plurality of ribs extends substantially perpendicularly from the lower surface to the upper edge.

12. The trigger sprayer housing of claim 8 wherein the saddle includes a pair of generous radius sections between each of the pair of shroud sides and the lower saddle surface, the radius sections being configured to conform to the user's hand.

13. The trigger sprayer housing of claim 8 wherein the lower saddle surface extends from a rearward edge to a forward edge, the forward edge having a fillet configured to conform to the user's hand.

14. The trigger sprayer housing of claim 8 further comprising a vent valve seat integrally formed into the housing, the vent valve seat being configured to accept a vent valve body to alternately open and close a vent passage between the container and ambient to thereby eliminate a vacuum in the container due to withdrawal of the liquid substance therefrom.

15. The trigger sprayer housing of claim 8 wherein the pump chamber includes a pump cylinder and a pump piston configured to reciprocate within the pump cylinder in response to actuation of the trigger sprayer, the pump cylinder being integrally formed within the trigger sprayer housing.

16. A trigger sprayer housing for completing a trigger sprayer for dispensing a liquid substance from a container in response to actuation by a user's hand, the housing being comprised of a shroud having a pair of substantially vertical sides extending to an integral ergonomic saddle having a substantially horizontal surface extending between the substantially vertical sides add configured to rest upon the user's hand during trigger sprayer actuation, the saddle having an open top and a plurality of ribs extending between the pair of shroud sides.

17. The trigger sprayer housing of claim 16 wherein the plurality of ribs are substantially vertical.

18. The trigger sprayer housing of claim 16 wherein the plurality of ribs are substantially planar.

19. The trigger sprayer housing of claim 16 wherein the saddle includes a pair of radii configured to conform to the user's hand, each of the pair of radii positioned between the pair of sides and the lower surface.

20. The trigger sprayer housing of claim 16 wherein the lower saddle surface includes a rearward edge and a forward edge, the forward edge including a fillet configured to conform to a user's hand.

* * * * *